US005553972A

United States Patent [19]

Bergeron et al.

[11] Patent Number: 5,553,972

[45] Date of Patent: Sep. 10, 1996

[54] APPARATUS FOR CONTAIMENT OF CONTAMINANTS DURING AN UNDERWATER DREDGING OPERATION

[76] Inventors: Raymond E. Bergeron, 3452 W. Jefferson, Trenton, Mich. 48183; William Priore, 1177 E. Center St., Marion, Ohio 43302

[21] Appl. No.: 426,902

[22] Filed: Apr. 21, 1995

[51] Int. Cl.[6] ..... E02B 3/00

[52] U.S. Cl. ..... 405/60; 405/52; 405/63

[58] Field of Search ..... 405/60, 63, 62, 405/64, 52, 66–72

[56] References Cited

U.S. PATENT DOCUMENTS

| | | | |
|---|---|---|---|
| 3,783,622 | 1/1974 | Gambel | 405/64 |
| 3,984,987 | 10/1976 | Light | 405/63 |
| 4,047,390 | 9/1977 | Boyce | 405/60 X |
| 4,201,495 | 5/1980 | Preus | 405/63 |
| 4,373,834 | 2/1983 | Grace | 405/60 |
| 5,385,427 | 1/1995 | Kateley et al. | 405/60 X |

FOREIGN PATENT DOCUMENTS

| | | | |
|---|---|---|---|
| 830701 | 3/1960 | United Kingdom | 405/62 |

*Primary Examiner*—Dennis L. Taylor
*Attorney, Agent, or Firm*—Gifford, Krass, Groh, Sprinkle, Patmore, Anderson & Citkowski, P.C.

[57] ABSTRACT

An apparatus is disclosed for containment of contaminants during an underwater dredging operation. The apparatus includes an elongated anchor which is adapted to lie on a water bed. A flexible sheet which is substantially impervious to silt has a bottom edge secured to the anchor. A float is secured to the top edge of the sheet so that the sheet forms a dam and prevents contaminated silt from passing from one side of the sheet to the other. In practice, a plurality of these sheets and anchors are disposed around and enclose a contaminated area thus maintaining silt within the interior of the enclosed area.

8 Claims, 1 Drawing Sheet

Fig-1
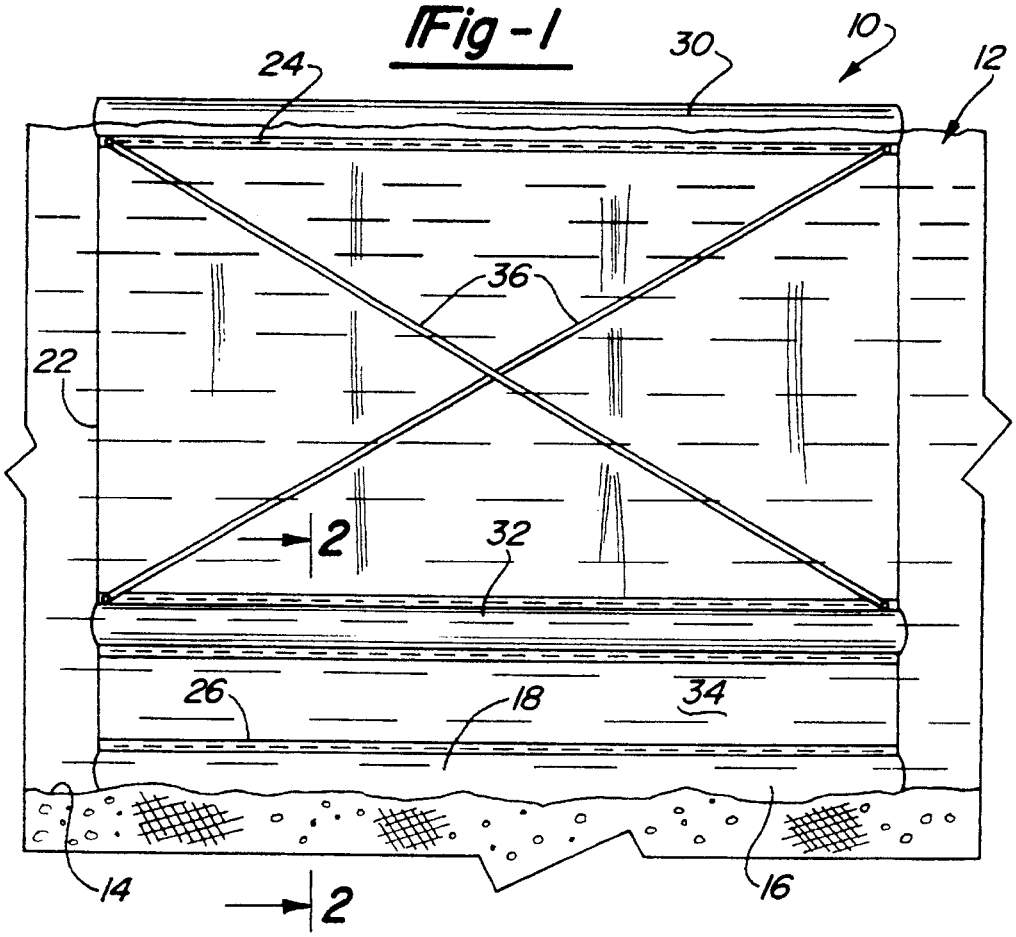
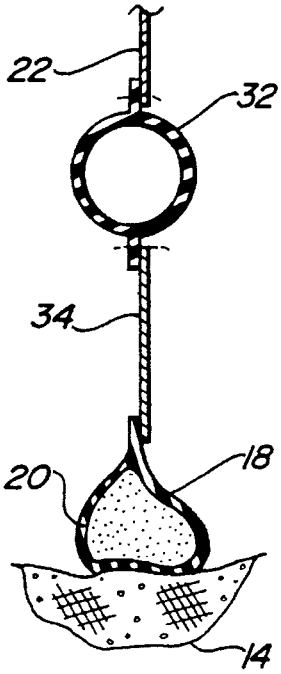
Fig-2
Fig-3
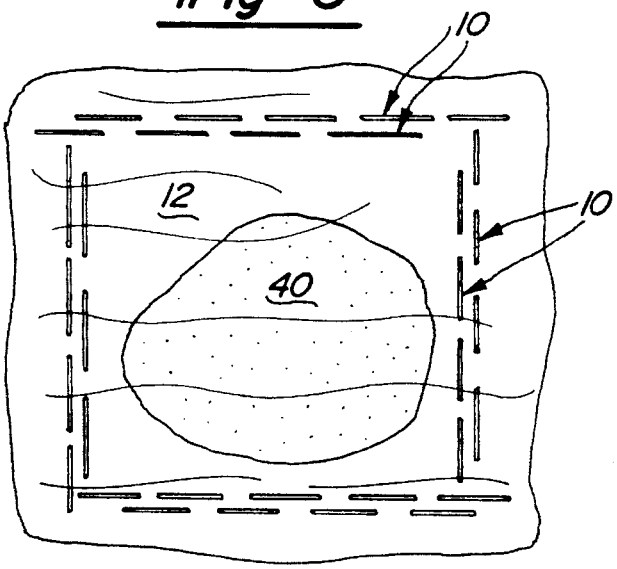

APPARATUS FOR CONTAIMENT OF CONTAMINANTS DURING AN UNDERWATER DREDGING OPERATION

BACKGROUND OF THE INVENTION

I. Field of the Invention

The present invention relates to a device for use in underwater dredging operations and, more particularly, a device for the containment of contaminants during such an underwater dredging operation.

II. Description of the Prior Art

There are many situations in which environmentally hazardous material is spilled or dumped on the bottom of a waterway such as a lake or river bed. In order to remove the environmentally hazardous material, it is necessary to dredge the material on the bottom of the water body in order to remove the contaminants from the bottom.

One problem that arises when dredging contaminants from the bottom of a water body is that the dredging operation creates turbidity in the water. The turbid water contains not only the silt from the water bed, but also the contaminants absorbed or adsorbed onto the silt. Consequently, during the dredging operation, the dredging operation itself may cause contamination of the area adjacent the original contamination. This problem is particularly severe where there is flowing water, such as a river.

SUMMARY OF THE PRESENT INVENTION

The present invention provides an apparatus for the containment of contaminants during an underwater dredging operation which overcomes all of the above-mentioned disadvantages of the previously known dredging operation.

In brief, the apparatus of the present invention comprises an elongated anchor which is adapted to lie on the bottom of the water body. In the preferred embodiment of the invention, the elongated anchor comprises a tube of material which is filled with an environmentally safe material, such as sand. The tube itself is flexible so that, when filled with sand, the elongated anchor lies on the bottom of the water bed.

A generally rectangular flexible sheet has its bottom edge secured to the anchor while a float, or series of floats, are secured along the top edge of the sheet. The sheet, furthermore, is constructed of a material that is somewhat permeable or is impervious to silt so that silt, along with any contaminants contained therein, are selectively stopped or cannot pass through the sheet.

A second float is also secured to the sheet so that the second float extends along the sheet a predefined distance above the anchor. The second float thus prevents the sheet from chaffing the bottom sediment during variations of the water level and causing turbidity.

In practice, a plurality of anchors, each having their own flexible sheet, are disposed in an overlapping relationship around the contaminated area. Thus, any turbidity in the contaminated area caused during the dredging operation is retained in the area by the overlapping sheet.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 1 is a plan view illustrating a preferred embodiment of the present invention in use is a waterway or water body;

FIG. 2 is a sectional view taken substantially along line 2—2 in FIG. 1 and enlarged for clarity; and FIG. 3 is a top plan view illustrating the use of the present invention during a dredging operation.

DETAILED DESCRIPTION OF A PREFERRED EMBODIMENT OF THE PRESENT INVENTION

With reference first to FIG. 1, a preferred embodiment of the containment apparatus 10 of the present invention is thereshown for use in a waterway 12 having a water bottom 14. The waterway 12 could comprise, for example, a river, lake, ocean, pond or the like.

Referring to FIGS. 1 and 2, the containment apparatus 10 comprises an elongated anchor 16 which is adapted to lie along the water bed 14. In the preferred embodiment, the anchor 16 comprises an elongated flexible tube 18 (FIG. 2) filled with an environmentally safe material 20, such as sand. The elongated tube 18 is preferably a "Geo-tube."

Still referring to FIGS. 1 and 2, the containment apparatus 10 comprises a generally rectangular sheet 22 having a top edge 24 and a bottom edge 26. The sheet 22 is constructed of a material which is substantially impervious to silt which may be created during a dredging operation. As such, the sheet 22 is preferably made of a fine mesh material but, alternatively, can be made of a material which is impervious even to water.

The bottom edge 26 of the sheet is attached to the anchor 16 in any conventional fashion, such as by sewing. An elongated float 30 is then secured in a conventional fashion to the upper edge 24 of the sheet 22 so that the sheet 22 forms a barrier between the float 30 which is above the water and the anchor 16 which follows the water bed 14.

Referring now particularly to FIG. 1, a second elongated float 32 is also secured to the sheet 22 in between the upper float 30 and the anchor 16. Preferably, the second float 32 is secured a predefined distance above the anchor 16, e.g. five feet, so that the area 34 of the sheet 22 in between the second float 32 and anchor 16 is maintained in a taut condition. The second float 32 thus prevents the sheet 22 from chaffing the water bed 14 and causing turbidity.

In the preferred embodiment of the invention, at least one, and preferably two tension cables 36 are provided between the floats 30 and 32. These tension cables may be constructed of any conventional material, such as rope, and generally maintain the rectangular shape of the sheet 22 and disperse stresses along the sheet.

With reference now to FIG. 3, an example of the use of the containment apparatus 10 of the present invention is thereshown from a top view. In FIG. 3, the water way 12 includes a contaminated area 40 which is contaminated with environmentally hazardous material or other undesirable contaminants. A plurality of the containment apparatuses 10 are provided around the contaminated area 40 so that each containment apparatus 10 overlaps its adjacent apparatus 10 by a few feet. Preferably, the containment apparatuses 10 completely surround the contaminated area 40 so that any turbidity caused during a dredging operation of the contaminated area 40 is contained within the interior boundaries of the containment apparatuses 10.

After the contaminants have been removed from the contaminated area 40, the containment apparatuses 10 must also be removed and disposed of in an environmentally safe fashion. In order to accomplish this, the tubes 16 are simply cut so that, upon removal of the sheets 22 and tubes 18 from the water, the sand dumps out from the tube 18 and onto the water bottom.

Having described my invention it can be seen that the present invention provides a novel containment apparatus for use with underwater dredging operations. Having described my invention, however, many modifications thereto will become apparent to those skilled in the art to which it pertains without deviation from the spirit of the invention as defined by the scope of the appended claims.

We claim:

1. Apparatus for containment of contaminants during an underwater dredging operation comprising:

an elongated anchor adapted to lie on a waterbed, a flexible sheet having a bottom edge and a top edge, said bottom edge being secured to said anchor, a first elongated float secured to said top edge of said sheet, a second elongated float secured to said sheet between said bottom edge and said top edge so that said second float is substantially parallel to and spaced upwardly from said anchor, and wherein said second float maintains a portion of said flexible sheet between said second float and said anchor in a taut condition so that second float together with said anchor prevents said sheet from causing turbidity of the water bed.

2. The invention as defined in claim 1 wherein said anchor comprises a tube filled with an environmentally safe material.

3. The invention as defined in claim 2 wherein said material comprises sand.

4. The invention as defined in claim 1 wherein said sheet is substantially rectangular in shape.

5. The invention as defined in claim 1 wherein said sheet is substantially impervious to silt.

6. The invention as defined in claim 5 wherein said sheet is constructed from polyethylene.

7. The invention as defined in claim 1 and comprising at least one tension cable extending diagonally across said sheet.

8. The invention as defined in claim 1 and comprising at least two tension cables extending diagonally across said sheet, said cables crossing each other adjacent a midpoint of said sheet.

* * * * *

UNITED STATES PATENT AND TRADEMARK OFFICE

CERTIFICATE OF CORRECTION

PATENT NO. : 5,553,972

DATED : September 10, 1996

INVENTOR(S) : Raymond E. Bergeron and William Priore

It is certified that error appears in the above-indentified patent and that said Letters Patent is hereby corrected as shown below:

Column 2, line 4, "is" should be --in --.

Signed and Sealed this

Twenty-eighth Day of January, 1997

*Attest:*

Bruce Lehman

BRUCE LEHMAN

*Attesting Officer*

*Commissioner of Patents and Trademarks*